United States Patent [19]

Luckenbach

[11] 4,243,517

[45] Jan. 6, 1981

[54] INTERNAL METHOD FOR REDUCING TRANSVERSE OXYGEN GRADIENTS IN FCCU REGENERATION

[75] Inventor: Edward C. Luckenbach, Mountainside, N.J.

[73] Assignee: Exxon Research & Engineering Co., Florham Park, N.J.

[21] Appl. No.: 58,490

[22] Filed: Jul. 18, 1979

Related U.S. Application Data

[63] Continuation-in-part of Ser. No. 867,782, Jan. 3, 1978, abandoned.

[51] Int. Cl.[3] ..... C10G 11/18

[52] U.S. Cl. ..... 208/164; 208/DIG. 1

[58] Field of Search ..... 208/DIG. 1, 164

[56] References Cited

U.S. PATENT DOCUMENTS

| | | | |
|---|---|---|---|
| 2,589,124 | 3/1952 | Packie | 208/150 |
| 3,206,393 | 9/1965 | Pohlenz | 208/163 |
| 3,410,793 | 11/1968 | Stranahan et al. | 208/164 |
| 4,035,284 | 7/1977 | Gross et al. | 208/120 |

*Primary Examiner*—Herbert Levine

*Attorney, Agent, or Firm*—John W. Ditsler; Edward H. Mazer

[57] ABSTRACT

A minor portion of the regeneration gas used to regenerate spent fluid catalytic cracking catalyst is introduced into the regeneration zone in the localized area of the terminus of the spent catalyst line so as to combust the volatile hydrocarbons in mixture with the spent catalyst being transferred from the reaction zone to the regeneration zone. This serves to reduce and/or minimize transverse oxygen gradients in both the dense phase catalyst bed and in the effluent gases therefrom such that excessive or undesirable afterburning in the dilute catalyst phase can be minimized or eliminated.

17 Claims, 2 Drawing Figures

INTERNAL METHOD FOR REDUCING TRANSVERSE OXYGEN GRADIENTS IN FCCU REGENERATION

CROSS-REFERENCE TO RELATED APPLICATIONS

Continuation-in-part of U.S. Ser. No. 867,782, filed Jan. 3, 1978 now abandoned.

BACKGROUND OF THE INVENTION

1. Field of the Invention

The present invention relates to the regeneration of catalysts employed in a fluid catalytic cracking process. More particularly, this invention relates to the combustion of volatile hydrocarbons in mixture with spent fluid catalytic cracking catalyst at or near the point said mixture enters the regeneration zone.

2. Description of the Prior Art

The fluidized catalytic cracking of hydrocarbons is well known in the prior art and may be accomplished in a variety of processes which employ fluidized solid techniques. Normally in such processes, suitably preheated, relatively high molecular weight hydrocarbon liquids and/or vapors are contacted with hot, finely divided, solid catalyst particles either in a fluidized bed reaction zone or in an elongated riser reaction zone, and maintained at an elevated temperature in a fluidized state for a period of time sufficient to effect the desired degree of cracking to lower molecular weight hydrocarbons typical of those present in motor gasolines and distillate fuels.

During the cracking reaction, coke is deposited on the catalyst particles in the reaction zone thereby reducing the activity of the catalyst for cracking and the selectivity of the catalyst for producing gasoline blending stock. In order to restore a portion, preferably a major portion, of the activity to the coke contaminated or spent catalyst, the catalyst is transferred from the reaction zone into a regeneration zone. Typical regeneration zones comprise large vertical cylindrical vessels wherein the spent catalyst is maintained as a fluidized bed by the upward passage of an oxygen-containing regeneration gas, such as air. The fluidized catalyst forms a dense phase catalyst bed in the lower portion of the vessel and a dilute catalyst phase containing entrained catalyst particles above, with an interface existing between the two phases. The catalyst is contacted with the oxygen-containing regeneration gas under conditions sufficient to burn at least a portion, preferably a major portion, of the coke from the catalyst. Flue gas, which normally comprises gases arising from the combustion of the coke on the spent catalyst, inert gases such as nitrogen from air, any unconverted oxygen and entrained catalyst particles, is then passed from the dilute catalyst phase into solid-gas separation means within the regeneration zone (e.g., cyclone separation) to prevent excessive losses of the entrained catalyst particles. The catalyst particles separated from the flue gas are returned to the dense phase catalyst bed. A substantially catalyst-free flue gas may then be passed from the separation means to equipment down-stream thereof, for example to a plenum chamber, or be discharged directly from the top of the regeneration zone. The regenerated catalyst is subsequently withdrawn from the regeneration zone and introduced into the reaction zone for reaction with additional hydrocarbon feed.

Commonly, spent catalyst from the reaction zone is passed therefrom to a stripping zone for removal of volatile hydrocarbons from the catalyst particles prior to transferring the catalyst to the regeneration zone. However, the volatile hydrocarbons not recovered as product from the reaction zone will pass with the spent catalyst into the regeneration zone wherein they are combusted in preference to the carbon on the spent catalyst. This results in exhaustion of the oxygen in the regeneration gas in the area where the spent catalyst and volatile hydrocarbons enter the regeneration zone. Normally the spent catalyst and volatile hydrocarbons enter the regeneration zone at an off-center location to avoid interference with the regeneration zone overflow well and/or auxiliary heating air section. Thus, one area of the dense phase bed is essentially starved of oxygen such that CO rather than $CO_2$ will be formed. In contrast, an excess of oxygen is present in the remaining portion of the dense phase bed since volatile hydrocarbons are not present therein.

The CO thus formed in this localized area passes from the dense phase bed into the dilute catalyst phase where it is reacted with oxygen leaving the oxygen-rich portions of the dense phase bed according to the following equation, an exothermic reaction:

$$2CO + O_2 \rightarrow 2CO_2 \quad (1)$$

The oxidation of carbon monoxide is commonly referred to as "afterburning" when it occurs in the dilute catalyst phase. (See "Oil and Gas Journal", Vol. 53, No. 3, pp. 93–94, 1955 for further discussion.) The "afterburning" causes a substantial increase in the temperature of the dilute catalyst phase which may exceed about 1500° F. Such high temperatures in the dilute catalyst phase can cause deactivation of the catalyst, thereby requiring additional catalyst replacement to the process in order to maintain a desired catalytic activity in the hydrocarbon reaction zone. Additionally, these high temperatures may cause damage to mechanical components of the regeneration zone, particularly in that portion of the regeneration zone in contact with the substantially catalyst-free flue gas wherein the temperature may increase to 1800° F. or greater. Such high temperatures are realized because the reaction shown in equation (1) proceeds rapidly within the substantially catalyst-free flue gas since there is very little entrained catalyst present to absorb the heat released and thereby reduce the rise in temperature. Thus, in that portion of the regeneration zone wherein the flue gas is substantially catalyst-free, there will occur a rapidly accelerating rise in temperature due to the heat released as complete combustion of carbon monoxide occurs in the absence of any means to moderate the temperature therein.

Thus, in view of the undesirable consequences resulting from the combustion of volatile hydrocarbons in the regeneration zone, it would be desirable to have a simple and convenient method for insuring not only the localized combustion of said hydrocarbons in the bed but also combusting the residual carbon on the catalyst so that the gases leaving all portions of the regenerator bed have approximately equal concentrations of oxygen and combustion products.

SUMMARY OF THE INVENTION

Now according to the present invention, it has been discovered that the formation of CO in the dense phase catalyst bed of the regeneration zone of a fluid catalytic cracking process due to the presence of volatile hydrocarbons in the spent catalyst mixture entering said regeneration zone from the reaction zone may be reduced and/or minimized by using a minor portion of the regeneration gas to combust said hydrocarbons in said dense phase bed at or near the point where said mixture is released into the regeneration zone. The amount of regeneration gas used to combust the hydrocarbons is not critical and, typically, will range from about 2 to about 20% of the regeneration gas normally employed.

DETAILED DESCRIPTION OF THE INVENTION

Figure 1:
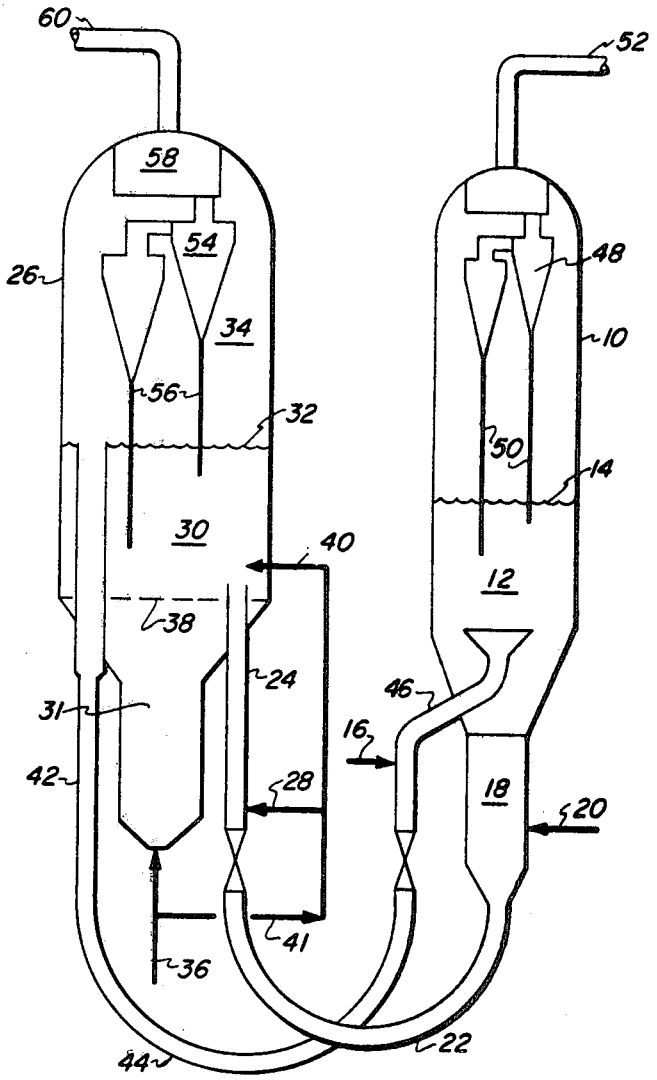
FIG. 1 is a flow diagram of the present invention as applied to a fluid catalytic cracking process.

Having thus described the invention in general terms, reference is now made to FIG. 1, which illustrates how the present invention may be applied to a typical fluid catalytic cracking process. Such details are included as are necessary for a clear understanding of how the present invention may be applied to said system. No intention is made to unduly limit the scope of the present invention to the particular configuration shown as other configurations are contemplated. Various items such as valves, pumps, compressors, steam lines, instrumentation and other process equipment and control means have been omitted therefrom for the sake of simplicity. Variations obvious to those having ordinary skill in the art of catalyst regeneration processes are included within the broad scope of the present invention.

Referring now to FIG. 1, there is shown a vertically arranged cylindrical reaction zone 10 containing a fluidized bed 12 of catalyst having a level indicated at 14, in which a hydrocarbon feedstock introduced at line 16 is undergoing catalytic cracking. Hydrocarbon feedstocks that can be suitably employed in a fluid catalytic cracking process include naphthas, light gas oils, heavy gas oils, widecut gas oils, vacuum gas oils, kerosenes, decanted oils, residual fractions, reduced crude oils, cycle oils derived from any of these, as well as suitable fractions derived from shale oil kerogen, tar sands bitumen processing, synthetic oils, coal hydrogenation, and the like. Such feedstocks may be employed singly, separately in parallel reaction zones, or in any desired combination. Hydrocarbon gas and vapors passing through fluid bed 12 maintain the bed in a dense turbulent fluidized condition having the appearance of a boiling liquid. Where more reactive catalysts are used there may not be a dense bed but merely a disperse phase of catalyst. The catalyst level may be held in the taper portion of the vessel above the stripping section 18.

In reaction zone 10, the cracking catalyst becomes spent during contact with the hydrocarbon feedstock due to the deposition of coke thereon. Thus, the terms "spent" or "coke-contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 wt. % or more. Typically, spent catalyst coke contents vary from about 0.5 to about 1.5 wt. %.

Prior to actual regeneration, the spent catalyst is usually passed from the reaction zone into a stripping zone 18 and contacted therein with a stripping gas, which is introduced into the lower portion of zone 18 via line 20. The stripping gas, which is usually introduced at a pressure of from about 10 to about 50 psig, serves to remove most of the volatile hydrocarbons from the spent catalyst. A preferred stripping gas is steam, although nitrogen, other inert gases or flue gas may be employed. Normally, the stripping zone is maintained at essentially the same temperature as the reaction zone, i.e. from about 850° to about 1100° F.

Stripped spent catalyst from which most of the volatile hydrocarbons have been stripped therefrom is then passed from the bottom of stripping zone 18, through a spent catalyst transfer line, such as U-bend 22 and interconnected vertical riser 24, which extends into the lower portion of a regeneration zone 26. Air is added to riser 24 through line 41 and line 28 in an amount sufficient to reduce the density of the catalyst flowing therein, thus causing the catalyst to flow upward into the regeneration zone 26 by simple hydraulic balance.

Riser 24 is shown entering regeneration zone 26 offcenter to avoid interference with the auxiliary heating air from section 31 of the regeneration zone. In the embodiment shown only one riser 24 is utilized. It is, however, within the contemplation of the subject invention that a plurality of risers may be used. To minimize transverse oxygen gradients where a plurality of risers 24 are utilized, it is contemplated that a plurality of lines 40 be utilized directing combustion air to each localized area where the spent catalyst is released into dense phase catalyst bed 30.

In the particular configuration shown in FIG. 1, the regeneration zone is a separate vessel (arranged at approximately the same level as reaction zone 10) containing a dense phase catalyst bed 30 having a level indicated at 32, which is undergoing regeneration to burn off coke deposits formed in the reaction zone during the cracking reaction, above which is a dilute catalyst phase 34. An oxygen-containing regeneration gas enters the lower portion of regeneration zone 26 via line 36 and passes up through a grid 38 and the dense phase catalyst bed 30, maintaining it in a turbulent fluidized condition similar to that present in reaction zone 10. As will be discussed in more detail hereinbelow, the present invention resides in passing a minor portion of said regeneration gas via lines 40 and 41 into the regeneration zone at or near the point where the mixture of spent catalyst and volatile hydrocarbons from stripping zone 18 is released into the dense phase catalyst bed so as to combust said volatile hydrocarbons.

Oxygen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen. Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec, preferably from about 1.5 to about 4 feet/sec.

Regenerated catalyst from the dense phase catalyst bed 30 in the regeneration zone 26 flows downward through standpipe 42 and passes through U-bend 44 into the reaction zone 10 by way of the transfer line 46, which joins U-bend 44 at the level of the oil injection line 16 above the U-bend. By regenerated catalyst is meant catalyst leaving the regeneration zone which has contacted an oxygen-containing gas causing at least a portion, preferably a substantial portion, of the coke present on the catalyst to be removed. More specifically, the carbon content of the regenerated catalyst can vary anywhere from about 0.01 to about 0.2 wt. %, but preferably is from about 0.01 to about 0.1 wt. %.

The hydrocarbon feedstock for the cracking process is injected into line 46 through line 16 to form an oil and catalyst mixture which is passed into the fluid bed 12 within the reaction zone 10. Product vapors containing entrained catalyst particles pass overhead from fluid bed 12 into a gas-solid separating means 48 wherein the entrained catalyst particles are separated therefrom and returned through dip-legs 50 leading back into fluid bed 12. The product vapors are then conveyed through line 52 into the product recovery system.

In regeneration zone 26, flue gases formed during regeneration of the spent catalyst pass from the dense phase catalyst bed 30 into the dilute catalyst phase 34 along with entrained catalyst particles. The catalyst particles are separated from the flue gas by a suitable gas-solid separation means 54 and returned to the dense phase catalyst bed 30 via diplegs 56. The substantially catalyst-free flue gas then passes into a plenum chamber 58 prior to discharge from the regeneration zone 26 through line 60. Typically, the flue gas will contain less than about 0.2, preferably less than 0.1, and more preferably less than 0.05 volume % carbon monoxide. Typically, the oxygen content will vary from about 0.4 to about 7 vol. %, preferably from about 0.8 to about 5 vol. %, more preferably from about 1 to about 3 vol. %, most preferably from about 1.0 to about 2 vol. %.

As noted above, most of the volatile hydrocarbons are stripped from the spent catalyst leaving reaction zone 10. However, the hydrocarbons not removed will be passed in mixture with spent catalyst (and steam) into the regeneration zone 26 wherein said hydrocarbons are combusted in preference to the carbon on the spent catalyst. As such, the immediate area adjacent to where the spent catalyst mixture is released into dense phase catalyst bed 30 of the regeneration zone becomes depleted in oxygen. Thus, sufficient oxygen is not present to combust CO to $CO_2$. As such, CO will pass into dilute catalyst phase 34 from said localized area of the dense phase catalyst bed. In contrast, an excess of oxygen will be present in other areas of the dense phase bed (i.e. areas where the volatile hydrocarbons are not present) such that CO will be converted to $CO_2$ therein. As such, transverse oxygen gradients (i.e. gradients in the direction perpendicular to the flow of the regeneration gas) will exist in the bed. When the CO passed into the dilute catalyst phase contacts the oxygen present therein from the other areas (i.e. oxygen-rich areas) of the bed, undesirable or excessive afterburning could occur according to equation (1).

The expression "undesirable or excessive" afterburning is meant to mean obtaining temperatures in the substantially catalyst-free flue gas system due to the combustion of carbon monoxide that exceed permissible catalyst deactivation or materials of construction limitations and the like. In general, undesirable or excessive afterburning corresponds to temperatures about 1450° F. Preferably, however, the temperature should be maintained below about 1420° F., more preferably below about 1400° F., to avoid the undesirable effects of excessive afterburning.

However, the problems associated with transverse oxygen gradients due to the presence of volatile hydrocarbons in the dense phase bed can be virtually eliminated by combusting said volatile hydrocarbons at and/or near the point where they enter said dense phase bed. This may be accomplished simply and conveniently be providing a minor portion of the regeneration gas to the localized area where the spent catalyst/volatile hydrocarbons mixture from the stripping zone is released into the dense phase catalyst bed of the regeneration zone. As used herein, the term "localized area" is defined to be that area within a locus of about one diameter of the spent catalyst transfer line from the terminus of the spent catalyst transfer line in dense phase catalyst bed 30. Normally, the spent catalyst transfer line has a diameter of about 18 inches to about 42 inches depending upon the desired catalyst flow rate and velocity, and the method of circulating the spent catalyst to regeneration zone 26. The amount of regeneration gas employed to combust the volatile hydrocarbons is also not critical and need be only an amount sufficient to at least partially combust the volatile hydrocarbons in the mixture with spent catalyst released into the dense phase bed. However, the amount of regeneration gas employed to combust the volatile hydrocarbons preferably is regulated to assure that only the approximate amount of regeneration gas required for combustion of the volatile hydrocarbons is added. Injection of an insufficient amount of regeneration gas will result in the continued presence of transverse oxygen gradients in the regeneration zone 26. Injection of an excess amount of regeneration gas will cause excessive catalyst entrainment, which might overload gas-solid separation means 54. However, if a considerable excess of regeneration gas were injected into riser 24, complete combustion of the volatile hydrocarbons and the coke would be effected in the vicinity of the point where the riser enters the vessel, but incomplete combustion would occur in other areas of the regeneration zone. A transverse oxygen gradient would be created and once again after burning would occur in dilute catalyst phase 34. The amount of regeneration gas injected into riser 24 preferably is regulated by monitoring the transverse oxygen gradient or a transverse temperature gradient. A schematic diagram and a detailed description of such a control system is presented hereinafter. Typically, the amount of regeneration gas injected into dense phase catalyst bed 30 through line 40 will correspond to from about 2 to about 20%, preferably from about 5 to about 9%, of the total regeneration gas. A little more regeneration gas is required through line 40 relative to the method disclosed in Ser. No. 58,491, filed on the same date herewith, which is a Continuation-in-Part of Ser. No. 866,496 now abandoned, because, when the regeneration gas is injected directly into the dense phase bed, a portion of the carbon on the spent catalyst will be combusted in addition to the volatile hydrocarbons. Also, introducing the regeneration gas directly into the bed rather than into the spent catalyst line has certain safety advantages since there is a large reservoir of catalyst available to absorb excessive amounts of heat released.

In the embodiment shown, an additional 4–12% of the total regeneration gas in line 36 is directed through lines 41 and 28 into riser 24 to fluidize the spent catalyst and regulate the spent catalyst circulation rate.

While the embodiment shown here discloses a catalyst cracking system in which the catalyst is transferred between the reaction zone and the regeneration zone by pressure balance, the subject invention is equally applicable to other type cracking systems and to other zone configurations and positions, such as upflow and downflow regeneration systems, including those which incorporate a slide valve to control the catalyst circulation rate.

Figure 2:
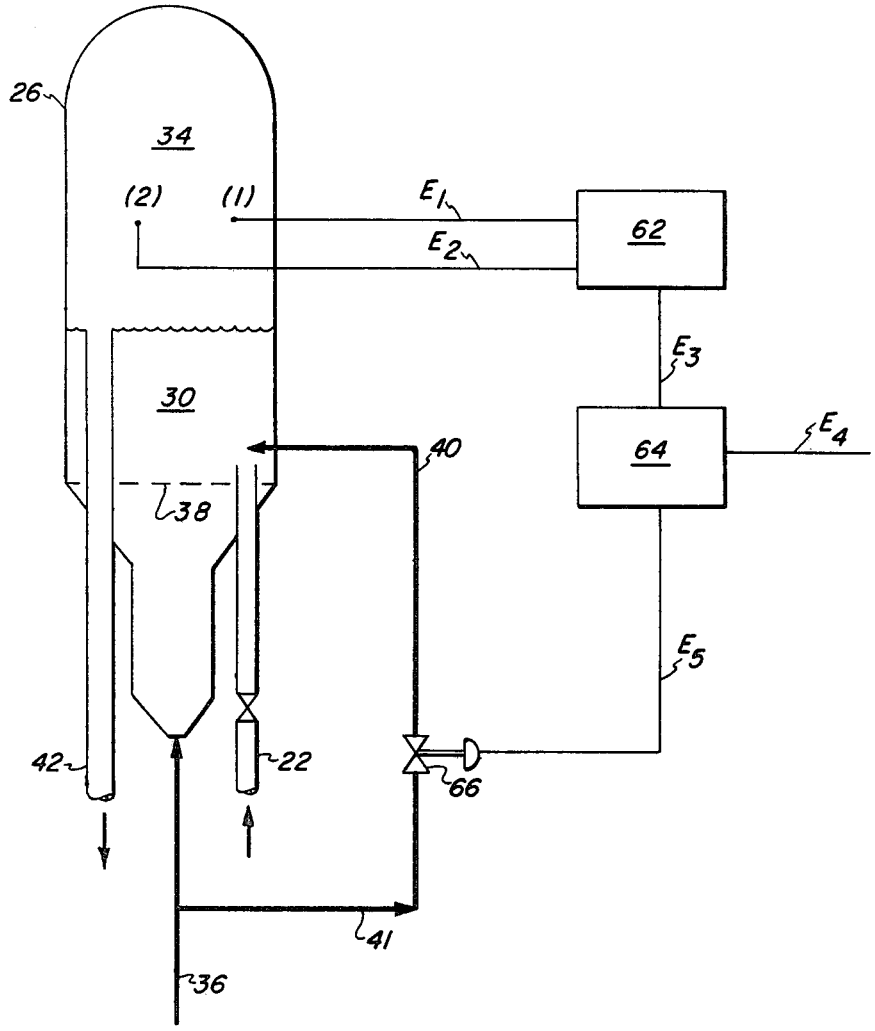
FIG. 2 shows a more detailed view of the present invention.

A better understanding of how the present invention may be applied to reducing and/or minimizing excessive or undesirable afterburning may be obtained by reference to FIG. 2 in which spent catalyst from a stripping zone (not shown) is introduced into the dense phase catalyst bed 30 of regeneration zone 26 via line 22. Also shown is a regeneration gas in line 36 passing up through grid 38 and into bed 30 where it reacts with the carbon on the spent catalyst therein such that a regenerated catalyst is passed from zone 26 via line 42. A minor portion of the regeneration gas in line 36 is shown being passed via lines 40 and 41 into the dense phase catalyst bed in the localized area where the spent catalyst is released into said bed to combust volatile hydrocarbons not removed in said stripping zone which otherwise would react preferentially with the oxygen passing through grid 38, thereby causing a depletion of the oxygen in a localized area where the spent catalyst enters bed 30 such that CO rather than $CO_2$ is formed. This, in turn, would create transverse oxygen gradients in not only bed 30, but in dilute catalyst phase 34, when gases are passed from bed 30. Hence, undesirable or excessive afterburning could result. The transverse oxygen gradients would be especially pronounced where the spent catalyst enters regeneration zone 26 off-center, as in the embodiment shown.

However, according to one embodiment of the present invention, should such gradients exist in dilute catalyst phase 34, oxygen concentrations could be sensed at, for example, spaced apart points (1) and (2). The concentration of hydrocarbon components or non-hydrocarbon components, such as carbon monoxide, ammonia, hydrogen, or oxides of nitrogen, which are oxidizable in regeneration zone 26 alternatively could be sensed. Or, since oxygen gradients across zone 26 will result in combustion of CO in dilute catalyst phase 34, a temperature gradient also will be formed which alternatively may be sensed by spaced-apart points (1) and (2). In the embodiment shown, points (1) and (2) preferably are disposed in a horizontal plane generally transverse to the direction of flow of the gas. However, with suitable biasing, points (1) and (2) could be disposed at any spaced-apart locations in dilute phase 34 at which the oxygen or other concentrations or the temperature differences resulting from the oxygen gradient could be detected. Signals $E_1$ and $E_2$, corresponding to the sensed temperature differences or oxygen or other concentration differences between points (1) and (2), respectively, could be developed and passed into a computation means 62 suitable for calculating a transverse temperature or oxygen gradient. Suitable computation means can be selected from a variety of digital and/or analog computing devices, depending upon the particular application. For example, the computation means could be a large computer capable of controlling an entire refinery complex or, if desired, a mini-computer designed for more limited applications. Such computation means are well known articles of commerce and thus are readily available in the marketplace.

The temperature, oxygen, or other gradient thus calculated can then be developed into a control signal $E_3$ and sent to a comparison means 64 which compares signal $E_3$ with a signal $E_4$ corresponding to the desired transverse gradient at the points being monitored such that a control signal $E_5$ is generated. The control signal $E_5$ is then applied to a control means 66 which regulates the amount of regeneration gas introduced into the dense phase bed via line 40 preferably to minimize the measured gradient. Thus, as would be obvious to one skilled in the art, the greater the deviation from the desired gradient (i.e., the greater the amount of volatile hydrocarbon introduced into bed 30), the greater will be the amount of regeneration gas employed in line 40. It should be understood that the amount of regeneration gas used in line 40 could, alternatively, be regulated according to other variables in dilute catalyst phase 34.

Therefore, combustion of the volatile hydrocarbons in mixture with the spent catalyst within a locatized area where said mixture enters the dense phase catalyst bed insures that the regeneration gas passing upward through the grid in said bed will burn only the carbon on the catalyst which is mixed throughout the bed. As such, the present invention serves to correct an imbalance in the amount of combustible material present in a localized area of the dense phase catalyst bed by removing a portion of said combustible material (the volatile hydrocarbons) immediately after their entering said bed. Such combustion of the volatile hydrocarbons also serves to prevent or minimize localized starvation of oxygen in the dense phase catalyst bed such that formation of CO rather than $CO_2$ is minimized. As such, there will be virtually no transverse oxygen gradients in the gases leaving the dense phase catalyst bed, thereby minimizing or preventing undesirable or excessive afterburning. As illustrated in FIG. 2, this can be done simply and conveniently on a continuous basis.

In general, any commercial catalytic cracking catalyst designed for high thermal stability could be suitably employed in the present invention. Such catalysts include those containing silica and/or alumina. Catalysts containing combustion promoters such as platinum can be used. Other refractory metal oxides such as magnesia or zirconia may be employed and are limited only by their ability to be effectively regenerated under the selected conditions. With particular regard to catalytic cracking, preferred catalysts include the combinations of silica and alumina, containing 10 to 50 wt. % alumina, and particularly their admixtures with molecular sieves or crystalline aluminosilicates. Suitable molecular sieves include both naturally occurring and synthetic aluminosilicate materials, such as faujasite, chabazite, X-type and Y-type aluminosilicate materials and ultra stable, large pore crystalline aluminisilicate materials. When admixed with, for example, silica-alumina to provide a petroleum cracking catalyst, the molecular sieve content of the fresh finish catalyst particles is suitably within the range from 5–15 wt. %, preferably 8–10 wt. %. An equilibrium molecular sieve cracking catalyst may contain as little as about 1 wt. % crystalline material. Admixtures of clay-extended aluminas may also be employed. Such catalysts may be prepared in any suitable method such as by impregnation, milling, co-gelling, and the like, subject only to provision of the finished catalyst in a physical form capable of fluidization.

As noted previously, the regeneration zone employed in the present invention normally comprises vertical cylindrical vessels wherein the catalyst to be regenerated is maintained as a fluidized bed by the upward passage of an oxygen-containing regeneration gas thereby forming a dense phase catalyst bed and a dilute catalyst phase with an interface in between. The dense phase bed, which is usually located in the lower portion of the regeneration zone is maintained at a temperature in the range of from about 1150°-1350° F., preferably from about 1250°-1320° F. The density of the dense phase bed may range from about 8 to about 30 lb/cu. ft.

The dilute catalyst phase is the primarily gaseous phase volume located above the phase bed within the regeneration zone. Specifically, the dilute phase contains relatively small quantities of catalyst compared to the dense phase bed. For example, the density of the dilute phase zone ranges from about 0.1 to about 1.0 lb/cu. ft. at the inlet to the separation means and from about 1 to about 5 lb/cu. ft. near the interface between the dense bed phase and the dilute catalyst phase. In many instances, the overall flow in the dilute phase is a concurrent flow of catalyst entrained with flue gases. It is contemplated that the dilute catalyst phase can include substantial quantities of the dense bed material which passes into that phase from excessive agitation or bubbling of gaseous materials through the dense bed. In general, the temperature in the dilute catalyst phase is at least that in the dense bed phase and is advantageously maintained within the range from about 1200° to about 1450° F., preferably from about 1310° to about 1370° F.

The term "substantially catalyst-free flue gas" is the gaseous phase volume located within or downstream of the catalyst separation means within the regeneration zone. Specfically, the "substantially catalyst-free flue gas" comprises flue gas from the dilute catalyst phase from which entrained catalyst particles have been substantially removed. This corresponds to the gaseous effluent from the separation means within the regeneration zone wherein the concentration of entrained catalyst particles will be less than about 1, preferably less than about 0.2, grains per actual cubic foot. The term "actual cubic foot" refers to the volume measured at actual operating conditions without correction to a standard temperature and pressure. The substantially catalyst-free flue gas from the separation means may be discharged to a variety of downstream equipment such as a dispersion means to redistribute the flue gas, stack valves, a plenum chamber and the like, prior to leaving the regeneration zone. By the use of the method of the present invention, substantial afterburning, and hence excessive temperatures in that portion of the regeneration zone wherein the flue gas is substantially catalyst-free, may be avoided. Preferably, the temperature in that portion of said regeneration zone is maintained at least equal to that of the dilute catalyst phase at the inlet to the separation devices but no more than 50° F., preferably no more than 30° F., and most preferably no more than 20° F., above that at said inlet. Although not necessary to the practice of the present invention, extraneous cooling means such as steam may be employed to further reduce the temperature and thereby inhibit the afterburning reaction in that portion of the regeneration zone wherein the flue gas is substantially catalyst-free.

One or more gas-solids separation means may be utilized in the dilute catalyst phase to separate entrained regenerated catalyst particles from the regeneration gas. Preferred separation means will be cyclone separators, multi-clones or the like whose design and construction are well known in the art. In the case of cyclone separators, a single cyclone may be used, but preferably more than one cyclone will be used in parallel or in series flow to effect the desired degree of separation.

The construction of the regeneration zone can be made with any material sufficiently able to withstand the relatively high temperatures involved when afterburning is encountered within the vessel and the high attrition conditions which are inherent in systems wherein fluidized catalyst is regenerated and transported. Specifically, metals are contemplated which may or may be limited. More specifically, ceramic liners are contemplated within any and all portions of the regeneration zone together with alloy use and structural designs in order to withstand temperatures of about 1400° F. and, for reasonably short periods of time, temperatures which may be as high as 1800° F.

The pressure in the regeneration zone is usually maintained in a range from about atmospheric to about 50 psig, preferably from about 10 to 50 psig. It is preferred, however, to design the regeneration zone to withstand pressures of up to about 100 psig. Operation of the regeneration zone at increased pressure has the effect of promoting the conversion of carbon monoxide to carbon dioxide and reducing the temperature level within the dense bed phase at which the substantially complete combustion of carbon monoxide can be accomplished. The higher pressure also lowers the equilibrium level of carbon on regenerated catalyst at a given regeneration temperature.

The residence time of the spent catalyst in the regeneration zone is not critical. In general, it can vary from about 1 to about 6 minutes. Typically it can vary from about 2 to about 4 minutes. The contact time or residence time of the flue gas in the dilute catalsyt phase establishes the extent to which the combustion reaction can reach equilibrium. The residence time of the flue gas may vary from about 10 to about 60 seconds in the regeneration zone and from about 2 to 15 seconds in the dense bed phase. Preferably, the residence time of the flue gas varies from about 15 to about 20 seconds in the regeneration zone and from about 6 to 10 seconds in the dense bed.

The present invention may be applied beneficially to any type of fluid cat cracking unit with little or no modifications and without limitations as to the spatial arrangement of the reaction, stripping, and regeneration zones thereof. The regeneration zone of a catalytic cracking unit can be designed independently from the reaction zone since the regeneration zone merely receives spent catalyst, oxidizes the coke thereon to regenerate the catalyst, and returns the regenerated catalyst to the reaction zone. Therefore, the reaction zone can be a pure transfer line i.e., one in which the reaction occurs in a single pipe type vessel directly terminating in a rough cut cyclone or cyclones, a conventional dilute riser/dense bed combination, or a dense bed alone.

Although the subject process has been described with reference to a specific embodiment, it will be understood that it is capable of further modification. Any variations, uses or adaptations of the invention following, in general, the principles of the invention are intended to be covered, including such departures from the present disclosure as come within known or customary practice in the art to which the invention pertains and as may be applied to the essential features hereinbefore set forth, and as fall within the scope of the invention.

What is claimed is:

1. In a fluidized catalytic cracking process which comprises:

(A) contacting a hydrocarbon feedstock with cracking catalyst in a reaction zone under cracking conditions to produce cracked hydrocarbon vapors and coke contaminated catalyst;

(B) stripping said coke contaminated catalyst with a stripping gas to remove volatile hydrocarbons therefrom, thereby forming a mixture of coke contaminated catalyst and unstripped volatile hydrocarbons;

(C) passing the mixture through a transfer line having a terminus in the dense phase catalyst bed of a regeneration zone;

(D) regenerating said coke contaminated catalyst by contacting said mixture in the regeneration zone under regeneration conditions with an upwardly flowing oxygen-containing regeneration gas, the catalyst in the regeneration zone being fluidized by the upward flow of said regeneration gas to form a dense phase catalyst bed and a dilute catalyst phase, the improvement which comprises providing additional oxygen to the localized area of the terminus of the transfer line in the dense phase catalyst bed to at least partially combust the volatile hydrocarbons in the mixture.

2. The process of claim 1 wherein said additional oxygen is obtained by passing a minor portion of said regeneration gas into said localized area.

3. The process of claim 2 wherein the minor portion of said regeneration gas passed to said localized area comprises from about 2 to about 20% of the total regeneration gas passed to said regeneration zone.

4. The process of claim 3 wherein the minor portion of said regeneration gas passed to said localized area comprises from about 5 to about 9% of the total regeneration gas passed to said regeneration zone.

5. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst and unstripped volatile hydrocarbons;

(C) passing the mixture through a transfer line having a terminus in the dense phase bed of a regeneration zone including a dense phase catalyst bed and a dilute catalyst phase; and (D) regenerating the coke contaminated catalyst by contacting the mixture under regeneration conditions with an oxygen-containing regeneration gas, the improvement which comprises:

(i) monitoring the temperature at at least two spaced-apart points in the dilute catalyst phase;

(ii) injecting a minor portion of the regeneration gas into the localized area of the terminus of the transfer line in the dense phase catalyst bed to combust the unstripped volatile hydrocarbons in the mixture; and (iii) periodically adjusting the amount of the minor portion of the regeneration gas injected into the localized area of the transfer line in the dense phase to regulate the temperature difference between the two points.

6. The process of claim 5 wherein the two spaced-apart points are disposed in a plane substantially transverse to the flow of gas through the dilute catalyst phase.

7. The process of claim 5 wherein the minor amount of regeneration gas injected into the localized area of the dilute catalyst phase comprises from about 2 to about 20% of the total regeneration gas passed to the regeneration zone.

8. The process of claim 7 wherein the minor amount of regeneration gas injected into the localized area of the dilute catalyst phase comprises from about 5 to about 9% of the total regeneration gas passed to the regeneration zone.

9. In a fluidized catalytic cracking process comprising:

(A) contacting a hydrocarbon feedstock with cracking catalyst in a reaction zone under cracking conditions to produce cracked hydrocarbon vapors and coke contaminated catalyst:

(B) contacting the coke contaminated catalyst with a stripping gas to partially remove volatile hydrocarbons therefrom thereby forming a mixture of coke contaminated catalyst and unstripped volatile hydrocarbons;

(C) passing the mixture though a transfer line having a terminus in a regeneration zone including a dense phase catalyst bed and a dilute catalyst phase; and (D) regenerating the coke contaminated catalyst by contacting the mixture under regeneration conditions with an oxygen-containing regeneration gas, the improvement which comprises:

(i) monitoring the oxygen concentration at two spaced-apart points in the dilute catalyst phase;

(ii) injecting a minor portion of the regeneration gas into the localized area of the terminus of the transfer line in the dense phase catalyst bed to combust the unstripped volatile hydrocarbons; and (iii) periodically adjusting the amount of the minor portion of the regeneration gas to thereby regulate the difference in oxygen concentration between the two spaced-apart points.

10. The process of claim 9 wherein the two spaced-apart points are disposed in a plane substantially transverse to the flow of gas through the dilute catalyst phase.

11. The process of claim 10 wherein the minor amount of regeneration gas injected into the localized area of the terminus of the transfer line in the dense phase bed comprises from about 2 to about 20% of the total regeneration gas passed to said regeneration zone.

12. The process of claim 11 wherein the minor amount of regeneration gas injected into the localized area of the terminus of the transfer line in the dense phase bed comprises from about 5 to about 9% of the total regeneration gas passed to said regeneration zone.

13. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst and unstripped volatile hydrocarbons;

(C) passing the mixture through a transfer line having a terminus in a regeneration zone including a dense phase catalyst bed and a dilute catalyst phase; and (D) regenerating the coke contaminated catalyst by contacting the mixture under regeneration conditions with an oxygen-containing regeneration gas the improvement which comprises:

(i) monitoring the hydrocarbon concentration at two spaced-apart points in the dilute catalyst phase;

(ii) injecting a minor portion of the regeneration gas into the localized area of the terminus of the transfer line in the dense phase catalyst bed to combust the unstripped volatile hydrocarbons; and (iii) periodically adjusting the amount of the minor portion of the regeneration gas to thereby regulate the difference in hydrocarbon concentration between the two spaced-apart points.

14. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst, unstripped volatile hydrocarbons and a nonhydrocarbon oxidizable component; and (C) passing the mixture through a transfer line having a terminus in a regeneration zone including a dense phase catalyst bed and a dilute catalyst phase; and (D) regenerating the coke contaminated catalyst by contacting the mixture under regeneration conditions with an oxygen-containing regeneration gas the improvement which comprises:

(i) monitoring the concentration of the nonhydrocarbon oxidizable component at two spaced-apart points in the dilute catalyst phase;

(ii) injecting a minor portion of the regeneration gas into the localized area of the terminus of the transfer line in the dense phase catalyst bed to combust the unstripped volatile hydrocarbons and oxidize at least a portion of the non-hydrocarbon oxidizable component; and (iii) periodically adjusting the amount of the minor portion of the regeneration gas to thereby regulate the difference in the concentration of the nonhydrocarbon oxidizable component between the two spaced-apart points.

15. The process of claim 14 wherein the nonhydrocarbon oxidizable component monitored is selected from the class consisting of carbon monoxide, ammonia, hydrogen, and oxides of nitrogen.

16. The process of claim 1 wherein the additional oxygen is added to the dense phase catalyst bed within a locus of one diameter of the spent catalyst transfer line from the terminus of the spent catalyst transfer line in the dense phase catalyst bed.

17. The process of claim 16, wherein the spent catalyst transfer line in the dense phase catalyst bed has a diameter of about 18 inches to about 42 inches.

* * * * *